US012209486B1

(12) United States Patent
Bland et al.

(10) Patent No.: US 12,209,486 B1
(45) Date of Patent: Jan. 28, 2025

(54) FIBER-SAFE SINGLE-RUN PERFORATING GUN

(71) Applicant: Halliburton Energy Services, Inc., Houston, TX (US)

(72) Inventors: Henry C. Bland, Calgary (CA); Timur Mukhtarov, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/410,870

(22) Filed: Jan. 11, 2024

(51) Int. Cl.

| | |
|---|---|
| ***E21B 43/119*** | (2006.01) |
| ***E21B 19/22*** | (2006.01) |
| ***E21B 43/112*** | (2006.01) |
| ***E21B 43/118*** | (2006.01) |
| ***E21B 47/095*** | (2012.01) |
| *E21B 7/04* | (2006.01) |

(52) U.S. Cl.
CPC ..... *E21B 43/119* (2013.01); *E21B 19/22* (2013.01); *E21B 43/112* (2013.01); *E21B 43/118* (2013.01); *E21B 47/095* (2020.05); *E21B 7/04* (2013.01)

(58) Field of Classification Search
CPC ..... E21B 43/119; E21B 47/095
See application file for complete search history.

(56) References Cited

U.S. PATENT DOCUMENTS

| | | | | |
|---|---|---|---|---|
| 4,227,582 | A * | 10/1980 | Price | E21B 43/114 219/121.84 |
| 6,378,607 | B1 | 4/2002 | Ryan et al. | |
| 6,837,310 | B2 | 1/2005 | Martin | |
| 9,617,847 | B2 | 4/2017 | Jaaskelainen et al. | |
| 9,810,809 | B2 | 11/2017 | Farhadiroushan et al. | |
| 9,945,215 | B2 | 4/2018 | Godfrey | |
| 10,047,592 | B2 | 8/2018 | Burgos et al. | |
| 11,105,188 | B2 | 8/2021 | Camp et al. | |
| 11,428,836 | B2 | 8/2022 | Mukhtarov et al. | |
| 11,448,066 | B2 | 9/2022 | Jeremic et al. | |
| 11,614,553 | B2 | 3/2023 | Mukhtarov et al. | |
| 11,719,080 | B2 | 8/2023 | Bland et al. | |

(Continued)

FOREIGN PATENT DOCUMENTS

| | | |
|---|---|---|
| CN | 209293768 U | 8/2019 |
| CN | 116335626 A | 6/2023 |

OTHER PUBLICATIONS

Word Press, e Flatpak, Research and installation, Jun. 1, 2019.

(Continued)

*Primary Examiner* — Giovanna Wright
(74) *Attorney, Agent, or Firm* — John Wustenberg; C. Tumey Law Group PLLC

(57) ABSTRACT

In general, in one aspect, embodiments relate to a method, that includes lowering a tool string down into a wellbore extending into a subterranean formation, where the tool string includes perforating charges, and one or more acoustic emitters, energizing the one or more acoustic emitters to form at least an acoustic signal while the tool string is being drawn up-hole, detecting the acoustic signal with a sensing cable disposed within the wellbore, determining an angular orientation of the tool string relative to the sensing cable based at least in part on the acoustic signal, and detonating at least one of the perforating charges when its firing direction is not directed at the one or more sensing cables.

20 Claims, 10 Drawing Sheets

(56) References Cited

U.S. PATENT DOCUMENTS

| | | | | |
|---|---|---|---|---|
| 11,796,696 | B2 | 10/2023 | Zheng et al. | |
| 2007/0158071 | A1* | 7/2007 | Mooney | E21B 43/1185 166/55.1 |
| 2013/0329522 | A1* | 12/2013 | Skinner | E21B 47/024 367/25 |
| 2014/0208843 | A1* | 7/2014 | Godfrey | E21B 43/119 73/152.58 |
| 2016/0349403 | A1* | 12/2016 | Farhadiroushan | G01N 21/68 |
| 2019/0153829 | A1 | 5/2019 | Roessler | |
| 2020/0199999 | A1* | 6/2020 | Cooper | G01V 1/46 |
| 2021/0062623 | A1 | 3/2021 | Camp et al. | |
| 2023/0213669 | A1 | 7/2023 | Yu et al. | |

OTHER PUBLICATIONS

International Search Report and Written Opinion for International Patent Application No. PCT/US2024/014484 dated Sep. 30, 2024. PDF file. 10 pages.

* cited by examiner

FIBER-SAFE SINGLE-RUN PERFORATING GUN

BACKGROUND

Wellbores are commonly drilled into a formation to recover natural resources, such as oil, natural gas, etc. Wellbore casing is usually set within a borehole and cement is pumped into the annular region between the casing and the borehole wall. Sensing fibers may be placed in the annulus prior to cementing and are thus permanently set in place when the cement hardens. These fibers may be used in a variety of applications, for example, to detect the size and location of micro seismic events (e.g., fractures formed during hydraulic fracturing), to obtain tomography and refraction data, to gauge effectiveness of hydraulic fracturing, to monitor well production, and others.

The wellbore casing is perforated to allow fluid communication between the wellbore and the formation, and production fluids enter the wellbore. Perforating of the casing is performed using perforating guns which are lowered to target depths within the wellbore on wireline and detonated. To prevent the guns from blasting through the sensing fibers, the wellbore is mapped beforehand. A fiber-line mapping run ("mapper run") is usually performed with a separate wireline tool and the perforating gun is then introduced at a gun orientation angle determined from the run. Personnel at the surface are typically required to set up a gun string at the correct gun orientation angle. Historically, the subsequently introduced guns have often used bottom-side, self-righting ballasts, i.e., "weight bars," which rely on gravity to ensure a bottom-weighted orientation of the gun, and thus their use has been limited to horizontal wells only.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
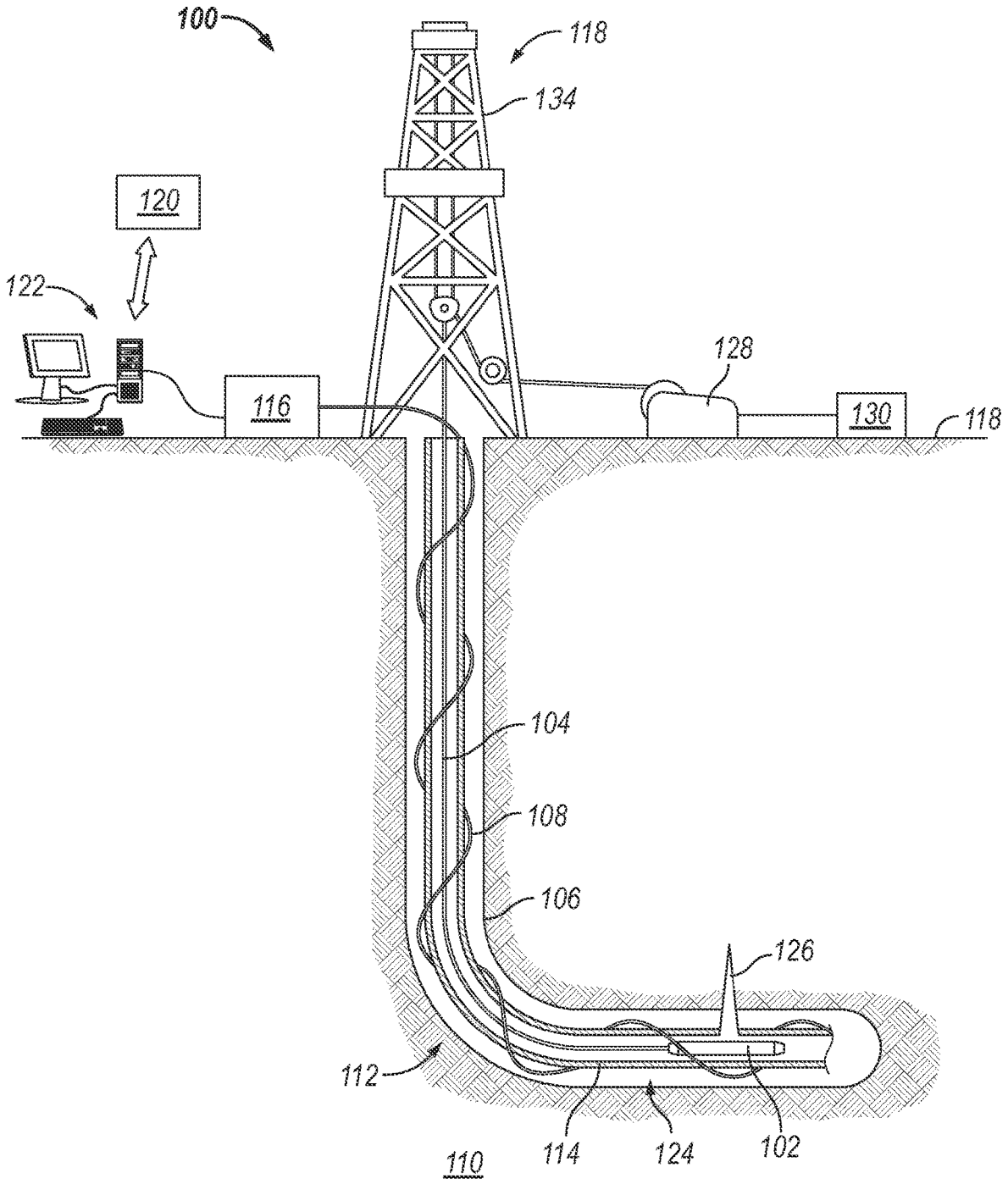
FIG. 1 is a schematic illustration showing a well system having a tool string and a fiber optic cable in accordance with some embodiments of the present disclosure.

Disclosed herein is a downhole tool for detecting the location of a sensing fiber and, more particularly, disclosed are methods and systems for detecting a sensing fiber and perforating a casing using a single wireline tool. In examples, detecting the location of sensing fiber(s) and subsequent perforating of casing may be performed by the downhole tool in a single run. Accordingly, as used herein, a "tool string" is a downhole tool that is used for both the detection of sensing fiber(s) as well as perforating wellbore casing.

Advantageously, the principles and teachings herein may reduce the risk of perforating through sensing fibers. These may also eliminate the need for a separate mapper run, and allow for perforating in vertical and deviated wellbores, in addition to horizontal. On-site nonproductive time (NPT) may also be potentially reduced due to the eliminating of the need for setting shooting angles of the perforating gun(s) at the surface, in some examples. "Time-to-perf," or the amount of time that elapses between drilling and perforating, may also be reduced.

As alluded to, traditional methods of perforating are generally limited to horizontal wells only. This is because weight bars rely on the direction of gravity as the reference angle and thus lack the requisite orthogonality to the direction of gravity in vertical wells. Such methods also commonly rely on down-hole electromagnetic imaging to detect the metallic flat-pack fiber of the sensing fibers. As mentioned, this creates the need for an additional, separate wireline tool to determine the position of these fibers. Moreover, the "self-righting" feature of the bottom-side ballast used in these methods may be characterized by unreliability, e.g., due to failure of swivel joints, excessive friction, etc.

The tool string as presently disclosed herein provides greater uniformity and predictability. This is achieved by rotating the gun body of the tool string as it is drawn up-hole, and only firing the gun when it is sure to miss the fiberoptic line on the outside of the casing. The position of the fiberoptic line at a given depth of the wellbore may be ascertainable using distributed acoustic sensing, which may sense the tool string as travels in the up-hole direction.

In general, the tool string comprises at least one gun body and perforating charges. The tool string is also equipped with hardware that allows it to emit sound waves which are detectable via the fiberoptic line, to be discussed in detail. This ultimately allows an information handling system or other suitable device to determine the relative position of the fiberoptic line relative to the tool string as it is run up-hole, thereby preventing the gun from discharging when it is aligned with the fiberoptic line.

As used herein, a "perforating gun" refers to a gun carrier which comprises at least one gun body for holding perforating charges. "Perforating charges" refers generally to an apparatus which contains at least an explosive material, charge case, and projectile (e.g., conical liner), and which is configured to launch the projectile through the gun body, casing, and annulus. In some examples, tool string 102 may be a "single-run perforating tool," meaning that it is capable of performing both sensing of sensing cable 108 and perforating in a single-run, without needing additional mapper runs.

FIG. 1 is a schematic illustration showing a well system 100 having a tool string 102 and a sensing cable 108 (i.e., "fiber optic line," "fiber optic cable," "distributed acoustic sensing fiber," or "DAS fiber") in accordance with some embodiments of the present disclosure. In this example, well system 100 is shown as comprising land-based infrastructure 118 which includes a derrick 134 suspending wireline 104 in this example. Land-based infrastructure 118 may comprise any land-based equipment used in the oil and gas industry including, without limitation, a servicing rig, drilling equipment, hydraulic fracturing equipment, coiled tubing, a hoist, drill pipe, rig floor, etc. While shown as a land-based operation, however, well system 100 may be an off-shore system without departing from the scope and spirit of the disclosure. For example, well system 100 may alternatively comprise offshore infrastructure which may include, without limitation, a floating vessel (e.g., drill ship, pipe-laying ship, tension-let platform, spar platform, production platform, floating production, storage vessel, offloading vessel, etc.), subsea conduit, riser, a deck, blowout preventors, hoisting apparatuses, semi-submersible platform, or rig, subsea tree, subsea wellhead, etc.

A tool string 102 may be disposed on wireline 104 in a wellbore 106 that extends into subterranean formation 110. Wellbore 106 is shown in this figure in the shape of an "L," with a vertical shaft connected by a heel 112 to a horizontal shaft. However, wellbore 106 is not limited to any particular geometry, and may comprise deviated, horizontal, and/or vertical portions, as previously mentioned. Casing 114 is disposed in the wellbore 106, and an annular area 124 ("annulus") between casing 114 and wellbore 106 may be pumped full of cement. Surface and production casing may also be disposed in wellbore 106, as well as production tubing. Sensing fiber 108 extends along wellbore 106 and may be wrapped (e.g., helically) around casing 114 as illustrated. The particular manner in which sensing cable 108 extends into the formation 110 is not meant to be limited to a single embodiment, however, is shown in this figure as occupying the annulus 114 and may thus be at least partially or fully embedded within cement (or tubing embedded within the cement) within the annulus. Other examples may include when sensing cable 108 is deployed via single- or dual-trip completion strings, behind casing 114, on tubing, and in pumped-down installations. Sensing fiber 108 may be permanently deployed in wellbore 106 via coiled tubing, wireline, slickline, or disposable cables, for example. Sensing fiber 108 may be a single, or a plurality of, fiber optic cables. In examples, sensor devices may be coupled to sensing cable 108 at multiple depths in the wellbore 106. In these examples, sensing cable 108 may receive data from sensor devices and transmit the data to a supervisory computing device 122 disposed at the surface 132. Data may include, for example, acoustic and/or temperature data.

Supervisory computing device 122 ("computer analyzer") may be coupled to a distributed acoustic sensing (DAS) interrogator 116. A DAS system may include, without limitation, DAS interrogator 116, an umbilical line, and sensing cable 108. Supervisory computing device 122 may include, or be connected to (in communication with), information handling system 120. In general, supervisory computing device 122 includes at least one processor and memory and is primarily tasked with receiving information from DAS interrogator 116. Information handling system 120, supervisory computing device 122, or both, may be configured to determine the relative orientation of the firing direction(s) of one or more perforating charges of tool string 102 with respect to sensing cable 108. While shown as occurring at the surface 132 using an information handling system 120, this determination may alternatively be performed downhole, in some examples. In some examples, information handling system 120 and/or supervisory computing device 122 may instruct (e.g., autonomously, semi-autonomously, or as a result of operator-input) detonation of one or more perforating charges. Detonation may thus occur when, for example, it is determined that the firing direction(s) is/are not aimed at sensing cable 108.

In operation, the tool string 102 is lowered on wireline 104 in wellbore 106, such as to the bottom of the well. The tool string 102 is then drawn up-hole, rotating as it travels upwards. As it does so, an acoustic emitter of the gun is energized, and the acoustic signature of the acoustic emitter is detectable via the sensing cable 108. A firing direction (e.g., firing direction 308 of FIG. 3), may be evaluated to determine if it is likely to perforate through the sensing cable 108. Upon reaching or nearing (e.g., within 1.5 meters of) a target depth and following verification by well system 100 that the firing direction is not aimed at the sensing cable 108, it may be determined that it is safe to detonate one or more of the perforating charges of tool string 102 at that depth. The tool string 102 may be stopped, and detonation may be triggered thereby resulting in a perforation 126 that extends at least through the casing 114, annular area 124, and into the formation 110.

Firing of the tool string 102 may be controlled by a gun firing panel 130, which may be in signal communication with tool string 102 via, for example, wireline 104 passing through hoist unit 128. As mentioned, gun firing panel 130 may trigger detonation of tool string 102. This may involve detonating an entire detonation train (i.e., a plurality of charges), or a select charge or group(s) of charges, e.g., individually. In some examples, detonating of tool string 102 may be performed using a firing head which may be disposed on a part of tool string 102 up-hole the perforating charges. The command to fire a particular perforating gun, charge, or group of charges may be issued by a human operator, or autonomously by an information handling system. In some examples, firing panel 130 may be configured to selectively fire only those perforating charges of the tool string which are deemed as non-interfering with sensing cable 108. This may be achieved, for example, using surface and/or downhole electronics (e.g., information handling system 120 of FIG. 1) which may make real-time determinations about which charges are safe to fire. These real-time determinations may be based at least in part on information of computer analyzer 122, DAS interrogator 116, information handling system 120, or any combination thereof, to use non-limiting examples. In some examples, these may be made by downhole electronics on-board the tool string 102. "Safe" in this context means that a projectile is unlikely (e.g., less than 1% likelihood) to, or guaranteed not to, perforate the sensing cable 108.

In some examples, sensing the position of sensing cable 108 and perforating may occur simultaneously, or near simultaneously. For example, a determination that it is safe to detonate may be performed within 1 minute of detonation of at least one perforating charge. Alternatively, from about 0.01 milliseconds ("ms") to about 10 ms, about 10 ms to about 1 second, about 1 second to about 5 minutes, or any ranges therebetween. In some examples, a DAS signal is processed, an evaluation performed and/or instruction to fire relayed to a perforating string, etc., in real-time. "Real-time" as used herein refers to a system, apparatus, or method in which a set of input data is processed and available for use within 100 ms. In further examples, the input data may be processed and available for use within 90 ms, within 80 ms, within 70 ms, within 60 ms, within 50 ms, within 40 ms, within 30 ms, within 20 ms, or any ranges therebetween. In some examples, real-time may relate to a human's sense of time rather than a machine's sense of time. For example, processing which results in a virtually immediate output, as perceived by a human, may be considered real-time processing.

Figure 2:
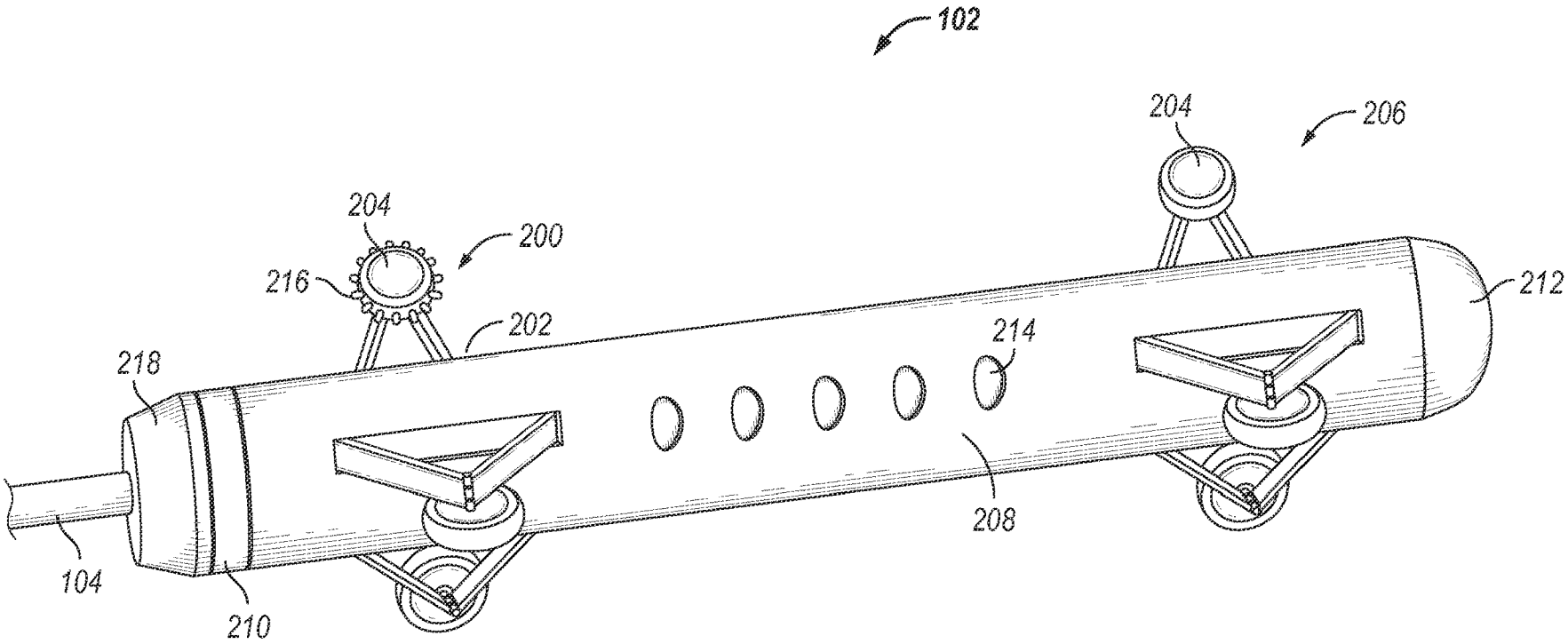
FIG. 2 is a schematic illustration showing a side-view of a tool string in accordance with some embodiments of the present disclosure.

FIG. 2 is a schematic illustration showing a side-view of a tool string 102 in accordance with some embodiments of the present disclosure. As illustrated, the tool string 102 may include a gun body 208, swivel adapter 210, bull nose 212, and centralizers 200. This example shows tool string 102 as a single gun. However, tool string 102 may alternatively comprise a plurality of perforating guns, with each perforating gun housing a plurality of perforating charges 214.

The centralizers 200 may be disposed on the outside of gun body 208. This figure shows centralizers 200, 206 radially aligned in pairs circumferentially disposed about the gun body 208. The centralizers most up-hole (i.e., closest to wireline 104) may be classified as "leading centralizers," with the centralizer 214 down-hole from the leading centralizer classified as a "trailing centralizer." Each pair of centralizers is shown spaced apart from the next pair about 120° as illustrated, such that there are three pairs. However, other configurations are possible, such as with multiple training centralizers, (e.g., sets of three or more centralizers 200), with spacing less than 120°, (e.g., 90°, 72°, 60°, etc.), or the like. In essence, any suitable number (e.g., 6, 8, 12, 16, etc.) of centralizers 200 may be attached to the tool string 102 to ensure the gun is properly and securely aligned in the wellbore 106. In some examples, the tool string 102 may comprise one or more tractors attached thereto, to assist with rotation/movement. However, this may not be necessary in some examples that use one or more centralizers 200, wheels 204, and swivel adapter 210, etc.

The centralizers 200 are shown in this figure to include extendable arms 202 and wheels 204, allowing them to contact the casing 114 with the wheels 204. This may limit side-to-side mobility of tool string 102 when it is run down-hole or drawn up-hole. The extendable arms 202 may be biased outwards in some examples to cause the wheels 204 to springingly engage the casing 114 to ensure wheels 204 contact the inner walls of the casing 114. This may be important in embodiments where one or more of the wheels 204 comprise sound-emitting facets 216, to be discussed later in detail.

Swivel adapter 210 allows the gun body 208 to rotate as the tool string 102 is drawn up-hole (or lowered down-hole in some examples). Swivel adapter 210 may be a tubular member that couples the gun body 208 to another tubular member 218 fixedly attached to the wireline 104. The swivel adapter 210 and gun body 208 may freely rotate about a central axis (e.g., center-line axis 310 of FIGS. 3A, 3B) of the tool string 102.

The bull nose 212 protects the tool string 102, for example, when it is conveyed to the bottom of a well. In addition, tool string 102 may further comprise tandems, spacers, or other coupling structures for coupling together tubulars.

The perforating charges 214 are schematically shown as circles to indicate an example of their placement within gun body 208. In this figure, the perforating charges are disposed between a leading centralizer and a trailing centralizer. However, some or all of these may alternatively be disposed down-hole to a bottom-most trailing centralizer in some examples, such as when it is desirable to prevent the wheels 204 from crossing paths with perforations 126 (e.g., referring to FIG. 1) to the casing 114 formed by detonating of one or more of the charges. It should be noted, however, that any suitable number and orientation of perforating charges may be housed by the gun body 208.

Figure 3A:
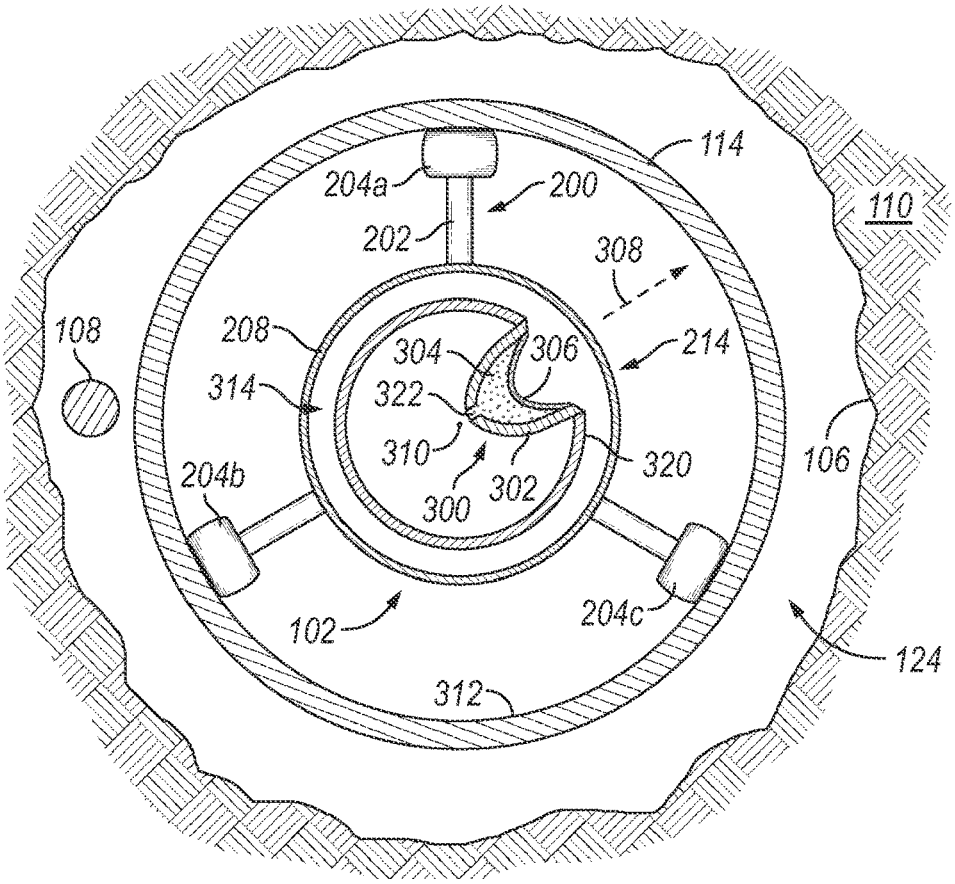
FIG. 3A is a schematic illustration showing a top-down cross-sectional view of a tool string disposed in a wellbore in accordance with some embodiments of the present disclosure.

FIG. 3A is a schematic illustration showing a top-down cross-sectional view of a tool string 102 disposed in a wellbore 106 in accordance with some embodiments of the present disclosure. While only a single layer of casing 114 is shown in this section, it should be understood that multiple casings are also possible. As illustrated, the tool string 102 comprises the gun body 208 and a perforating charge 214, which comprises a charge assembly 300. The charge assembly 300 comprises a charge case 302, an invertible conical liner 306, and explosive material 304 (e.g., shaped charge). Without limiting to any particular embodiment, a charge assembly 300 may be attached to or form part of a charge tube 320, which may serve in some examples to keep one or more of the charge assemblies separated from the gun body 208, e.g., to insulate the detonation material from static charge build-up. A detonating cord may be disposed at any suitable location within an inner area 314 of the gun body 208, for example, along center-line axis 310, wrapped around a charge tube 320, etc., to relay a detonation signal to the perforating charge 214, e.g., through an aperture 322 going through charge case 302.

The arms 202 of each centralizer 200 extend from an outer surface of the gun body 208 to wheels 204*a*, 204*b*, and 204*c*, which contact an inner surface 312 of the casing 114. The sensing cable 108 is shown off to the side of the casing 114, disposed within the annular area 124 of the wellbore 106. Upon detonation, high-pressure, expanding gas generated by the detonation of the explosive material 304 causes the invertible conical liner 306 to launch through the gun body 208, the casing 114, cement within the annular area 124, and into the formation 110 to create a perforation 126 (e.g., referring to FIG. 1). The shape of the invertible conical liner 306 inverts to form the projectile. While not shown, the area of the gun body 114 perforated by the projectile may be weakened, e.g., by using one or more scallops, to ensure the projectile exits the tool string 102 in an appropriate firing direction 308.

A firing direction 308 is indicated by an arrow, which is shown in this figure as being oriented opposite from (i.e., 180° away from) the sensing cable 108 at the z-coordinate of the cross section represented by FIG. 3A. Alternatively, however, the firing direction 308 may be oriented in any suitable manner such that it does not interfere with sensing cable 108. For example, at any angle between about 5° to about 355°, or any ranges therebetween.

Figure 3B:
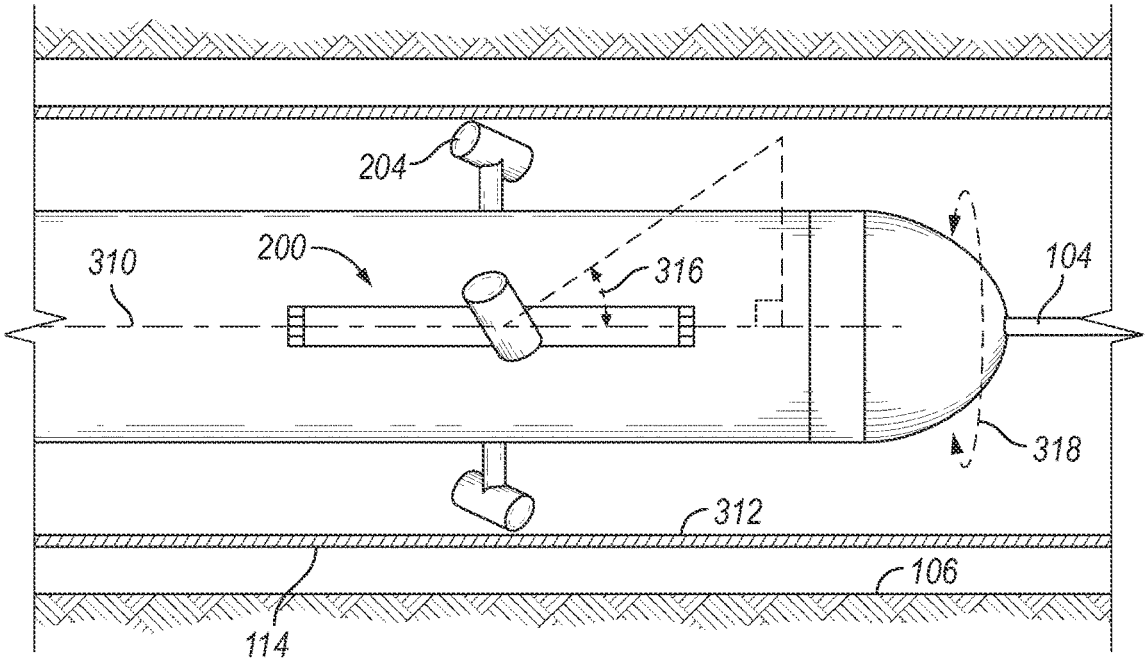
FIG. 3B is a schematic illustration showing a side-view of the tool string of FIG. 3A to show wheels disposed at an angle relative to a central axis of the tool string.

As alluded to previously, the tool string 102 rotates as it is drawn up-hole. In examples, this may be achieved by tilting the wheels 204*a*, 204*b*, 204*c* so that they contact the inner surface 312 of the casing 114 at an angle. In examples, the tool string 102 may undergo about 1 revolution every 3 meters traveled. Alternatively, from about 0.1 revolutions to about 5 revolutions per 3 meters traveled, or any ranges therebetween. Other, slower rotation rates are possible as well. FIG. 3B shows an example of how a wheel 204 may be tilted relative to the center-line axis 310. This ultimately causes there to be a differential pressure applied to the gun body 208 by the centralizers 200 when the tool string 102 is drawn up-hole, ultimately causing the gun to rotate about the center-line axis 310.

FIG. 3B is a schematic illustration showing a side-view of the tool string 102 of FIG. 3A to show wheels 204 disposed at a tilt angle 316 relative to a center-line axis 310 of the tool string. As illustrated, the tilt angle 316 may be about 30° relative to the center-line axis 310. Alternatively, from about −60° to about 60°, or any ranges therebetween, relative to center-line axis 310. In general, the steeper the tilt angle 316, the greater the number of rotations undergone by the tool string 102 per distance traveled in the wellbore 106. The tilt angle 316 may be a singular, fixed angle, or may be variable or adjustable. In the latter case, an adjustable tilt angle 316 may allow for the tool string 102 to be precisely navigated to the correct angular orientation so as to avoid perforating the sensing cable 108. Adjustment of the tilt angle 316 may be controlled, for example, by information handling system 120 (e.g., referring to FIG. 1) or by downhole electronics (e.g., on-board the tool string 102).

An arrow indicated at 318 shows how the tilt angle 316 may result in clockwise or counterclockwise rotation of the tool string relative to the wireline 104 when the gun is drawn up-hole along casing 114 at the inner surface 312. In alternative examples, rather than the wheels 204 themselves having a tilt angle 316, the centralizer 200 itself, or the extendible arm 202, may be instead tilted at the tilt angle 316, to produce the same effect. In some examples, axles to which wheels 204 may be attached are rotated at the tilt angle 316. Advantageously, rotation of the tool string 102 may be performed without the need for down-hole electronics dedicated to this purpose, in some examples.

Figure 4A:
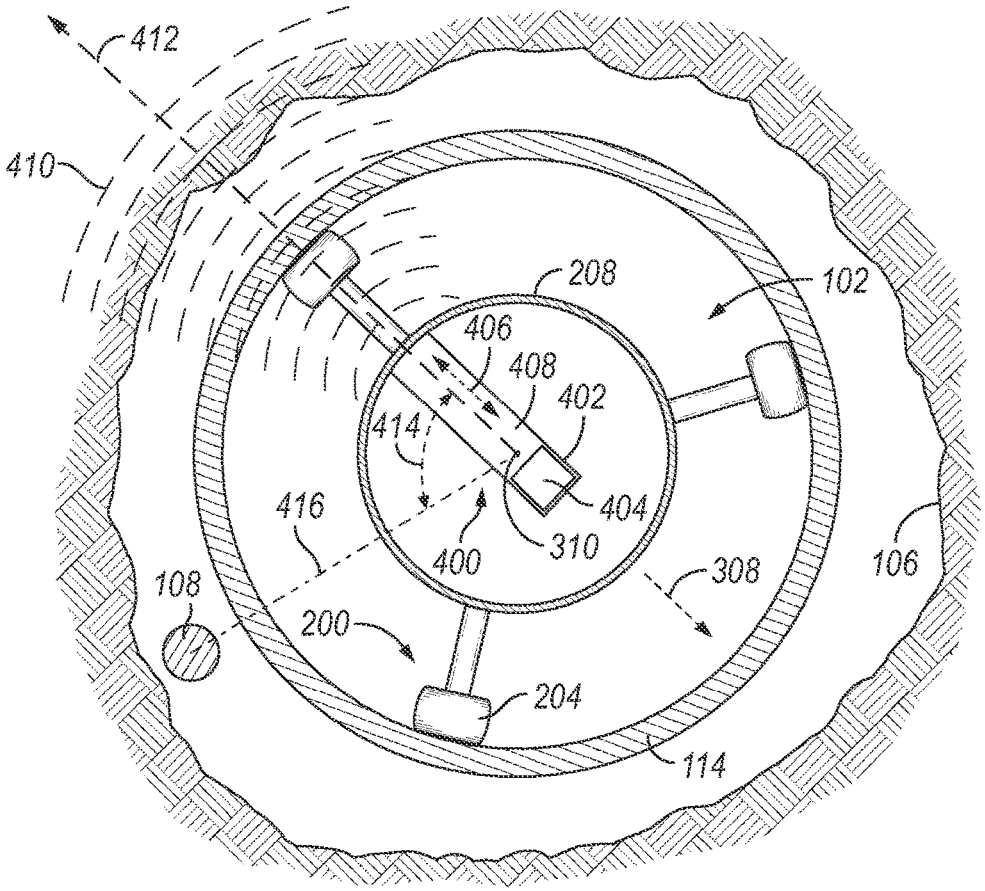
FIG. 4A is a schematic illustration showing a top-down cross-sectional view of a tool string having an acoustic emitter and disposed in a wellbore in accordance with some embodiments of the present disclosure.

FIG. 4A shows a schematic illustration showing a top-down cross-sectional view of a tool string 102 having a directional acoustic emitter 400 in accordance with some embodiments of the present disclosure. As illustrated, directional acoustic emitter 400 may be disposed within the tool string 102, such as within the gun body 208 or charge tube 320 (e.g., referring to FIG. 3A), for example. The purpose of the directional acoustic emitter 400 is to produce an acoustic signal 410 detectable by sensing cable 108, which is used to determine the relative position and/or angular orientation of the tool string 102 relative to the sensing cable 108.

Without being limited to any particular embodiment, the directional acoustic emitter 400 may include a body 402 housing an inner region 408 and a moveable member 404. A bi-directional arrow at 406 shows how moveable member 404 may be jostled back and forth at one or more specific frequencies, thereby energizing the directional acoustic emitter 400 and producing an acoustic signal 410. The acoustic signal 410 may have a specific energy or signature, which may be detected by the sensing cable 108. Depending on the strength and/or frequency of acoustic signal 410, an information handling system 120 or supervisory computing device 122 at the surface 132 (e.g., referring to FIG. 1) may deconvolute and/or analyze the signal and thereby determine the relative orientation of the firing direction 308 relative to the position of the sensing cable 108.

As the tool string 102 spins, the direction indicated at 412 of the acoustic signal 410 also rotates. Since the strength of the acoustic signal 410 detected by sensing cable 108 is greater when the acoustic signal 410 is directly aimed at it, one simple method of determining proximity of the directional acoustic emitter 400 to sensing cable 108 is to correlate amplitude of the acoustic signal 410 with the angular orientation (e.g., angle 414) of the acoustic emitter. Angle 414 is the angle between the primary direction of the acoustic signal 410 and a straight line 416 connecting the center-line axis 310 to sensing cable 108. Determination of the angle 414 may ultimately be used to determine the direction of the firing direction 308 relative to the sensing cable 108. One drawback of methods that only rely on these correlations, however, is that even minor variations in acoustic coupling between the directional acoustic emitter 400 and sensing cable 108 may disproportionately affect the amplitude of the acoustic signal 410 and thus diminish the reliability of predictions.

In an alternative example, however, a Doppler shift may be used instead of (or in combination with) these correlations to predict the angular orientation of the tool string 102. In these examples, directional acoustic emitter 400 may be configured to transmit a constant frequency. As directional acoustic emitter 400 approaches and recedes away from sensing cable 108 (i.e., during to the rotation of the tool string 102), a Doppler shift effect may be observed in the acoustic signal 410. The Doppler shift effect is very small at low velocities yet may still be detectable, in some examples. Information handling system 120 (e.g., referring to FIG. 1) may detect this Doppler shift, and then base its predictions of the angular orientation on the shift. Detection of the Doppler shift may involve, for example, isolating channels on a DAS and/or using a phase-locked-loop. Recorded frequencies may be tracked, e.g., as a function of depth, to derive a relationship between the recorded frequencies and the position (e.g., depth) in wellbore 106. In some examples, when the output frequency of directional acoustic emitter 400 is constant, the depths where there is a rapid shift (e.g., high to low) in the recorded frequencies may correspond to depths where directional acoustic emitter 400 is closest to the sensing cable 108. Advantageously, using the Doppler shift to calculate position in this manner may be performed even when there is poor acoustic coupling between the tool string 102 and the sensing cable 108.

In another alternative example, the relative orientation of the tool string 102 may instead, or in addition, be determined by using a normalization technique. In these examples, rather than basing predictions on single amplitude measurements individually, the amplitudes of the acoustic signal 410 are normalized across a plurality of depth points, and the shape of the amplitude envelope is analyzed to determine the position of the tool string 102 with respect to the sensing cable 108.

In another alternative example, multiple acoustic emitters 400 may be included in the tool string 102. These may be included within the gun body 208, on one or more of the centralizers 200, or a combination thereof. For example, a tool string 102 may comprise any number (e.g., 1, 2, 3, 5, etc.) of acoustic emitters. Where multiple acoustic emitters are used, they may emit acoustic signals at the same, or different, frequencies. Similarly, such acoustic signals 410 may be aimed in the same, or different, directions, and may be used to detect the position of a single, or multiple fiber optic cables. However, an acoustic emitter may, but need not necessarily be, aimed in any particular single direction. Rather, an "acoustic emitter" in this context refers to any device or feature configured to generate an acoustic signal in a manner that is detectable using a fiber optic cable disposed behind a wellbore casing and sufficient to determine the respective angular orientation of a perforating gun relative to a sensing cable. Examples may include, for example, a directional acoustic emitter (e.g., directional acoustic emitter 400), a multi-faceted surface, (e.g., of a wheel of a centralizer, to be discussed in more detail in later figures), or the like.

Figure 4B:
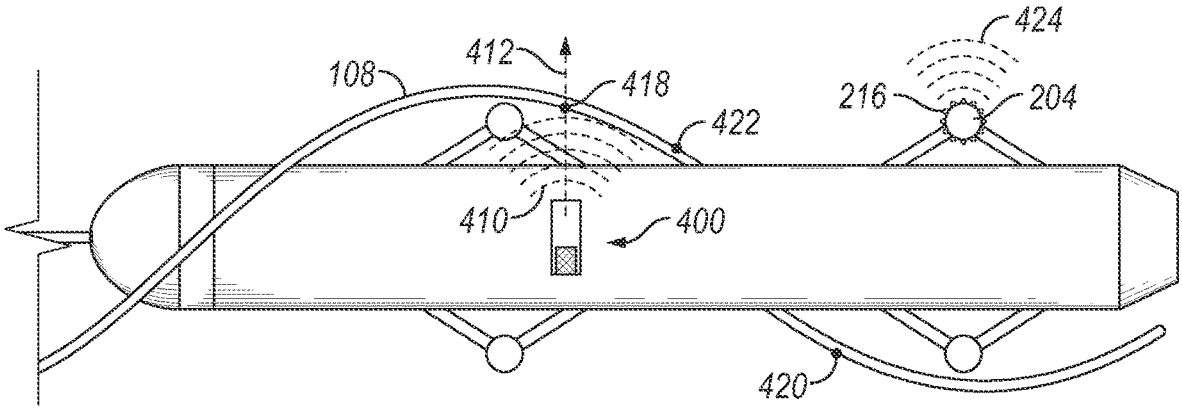
FIG. 4B is a schematic illustration showing a cross-sectional side view of the tool string of FIG. 4A in accordance with some embodiments of the present disclosure.

FIG. 4B is a schematic illustration showing a cross-sectional side view of the tool string 102 of FIG. 4A in accordance with some embodiments of the present disclosure. In this figure, however, the direction 412 of an acoustic signal 410 emitted by directional acoustic transmitter 400 is shown as being generally orthogonal to sensing cable 108. The amplitude of the acoustic signal 410 detected at the intersection 418 between the direction 412 and sensing cable 108 is likely to be greater than that detected at points 420 and 422 of the sensing cable 108, for example. This figure also shows that a tool string 102 may, in addition or as an alternative to directional acoustic emitter 400, comprise one or more facets 216 disposed on the outer surface of wheel 204 for generating acoustic signal 424. In general, the greater the number of facets, the higher the emitted frequency.

The "travel time" elapsed between when an acoustic signal 410 and/or 424 is emitted and when it is received by a DAS fiber (e.g., sensing cable 108 of FIGS. 1, 2, 3A, 4A, 4B) may be used to ascertain the precise location of the source of the acoustic signal. By careful examination of seismic arrival times and seismic wavelet shapes, the position of an acoustic emitter may be determined. Such acoustic signals 410, 424 may be a broadband signal, such as a square-wave. When the directional acoustic emitter 400 is closest sensing cable 108, the energy ratio of high-to-low frequencies will be maximized. However, as the directional acoustic emitter 400 moves away from sensing cable 108, its ray-paths become increasingly convoluted and the acoustic signal 410 arrives at sensing cable 108 via multiple pathways, which may reduce the high-to-low frequency ratio. As used herein, "high frequencies" refer to frequencies greater than 1 kilohertz (kHz), and "low frequencies" refer to frequencies less than 1 kHz.

In some examples, a pulse may be sent down the wireline to energize an acoustic emitter synchronously with the timing of the pulse. By measuring the travel time, it may be determined when the distance between the acoustic emitter and the sensing cable 108 is minimized and thus when the acoustic emitter is closest to the sensing cable 108.

Figure 5A:
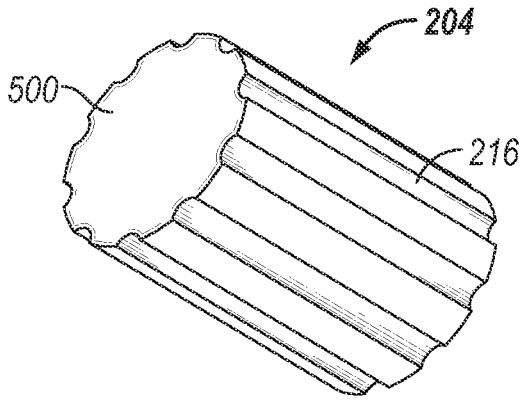
FIG. 5A is a side-view of a wheel having a sound-emitting body having shallow slots in accordance with some embodiments of the present disclosure.
Figure 5B:
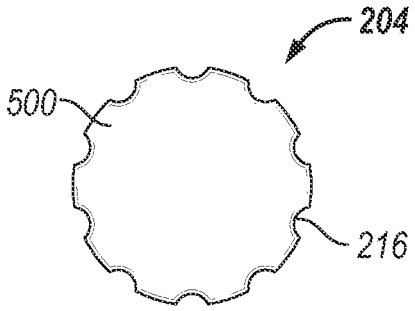
FIG. 5B is a top-down view of the wheel of FIG. 5A.

FIG. 5A is a side-view of a wheel having sound-emitting ridges in accordance with some embodiments of the present disclosure. As alluded to previously, an acoustic emitter may instead of, or in addition to, a directional acoustic emitter 400 (e.g., referring to FIGS. 4A, 4B), comprise a multi-faceted surface of a wheel 204. The types(s) and/or number of facets 216 comprising the multi-faceted surface are various and may include, as illustrated in this figure, a plurality of ridges extending from a distal end 500 along the axial length of the wheel 204. For example, FIG. 5B shows how the facets 216 may at least partially extend into the body of a wheel 204. The facets are shown in these figures as extending along the entire length of wheel 204, however, may extend across only a part thereof. In essence, facets 216 may be acoustically energized due to the contact between a wheel 204 and the inner surface 312 of casing 114 (e.g., referring to FIG. 3A, 3B) thereby emitting sound. As the tool string 102 (e.g., referring to FIGS. 1, 2, 3A, 3B) is drawn up-hole, the wheels 204 roll against the inner surface 312 of the casing 114. For wheels 204 having the multi-faceted surface(s), frictional contact between the wheels 204 and the inner surface 312 imparts energy to the facets, causing them to vibrate at a specific frequency (or frequencies). This generated acoustic signal may then travel through the casing and annulus to the sensing cable 108, where the sound may be detected by sensing cable 108.

The detected signal is then deconvoluted and/or analyzed to determine the relative position of the sensing cable 108 relative to the firing direction 308. Deconvolution and/or analysis may be performed, for example, after relaying the signal to the surface 132 (e.g., referring to FIG. 1), or directly using down-hole electronics, e.g., electronics disposed on the tool string 102, in some examples.

Thus, in some examples, arms 202 of a centralizer 200, or the centralizer 200 itself, (e.g., referring to FIG. 2), may be characterized as a "sounding arm." As used herein, "sounding arm" references a centralizer's ability to emit acoustic energy detectable by the sensing cable 108 to a degree that the angular orientation (e.g., firing direction 308 of FIG. 3A) of the tool string 102 is ascertainable. One or more leading centralizers, trailing centralizers, or a combination thereof, may comprise one or more wheels 204 having an acoustically-energizable, multi-faceted surface. In examples, a tool string 102 may comprise a single, or multiple, sounding arms.

Figure 6A:
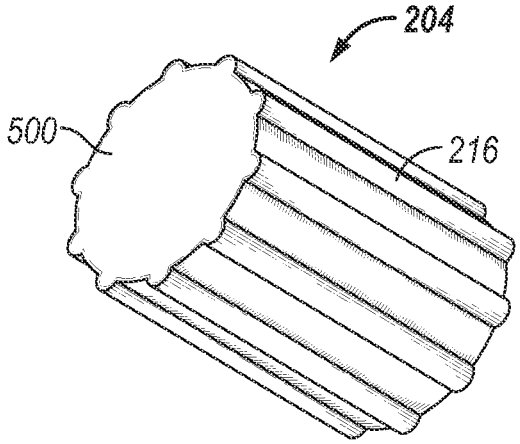
FIG. 6A is a side-view of a wheel which has a sound-emitting body having ridges in accordance with some embodiments of the present disclosure.
Figure 6B:
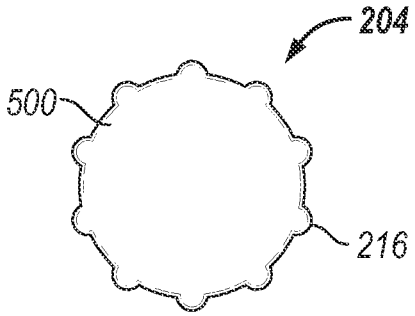
FIG. 6B is a top-down view of the wheel of FIG. 6A.

FIGS. 6A and 6B are a side-view and a top-down view, respectively, of a wheel 204 which has acoustically-energizable facets 216 in accordance with some embodiments of the present disclosure. As illustrated, facets 216, which are shown as protrusions in this figure, may extend along a substantial length of (e.g., entirety of) wheel 204. Alternatively, along from about 5% to about 95% of the length of wheel 204, or any ranges therebetween.

Figure 7A:
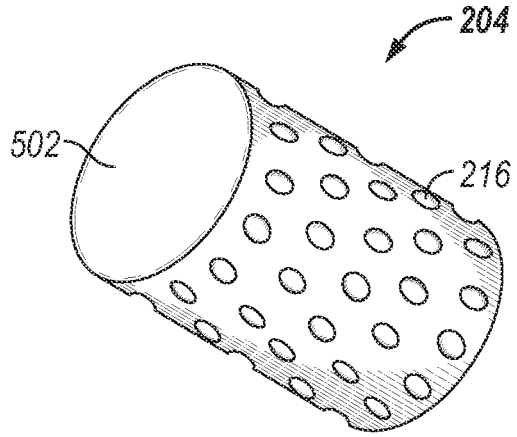
FIG. 7A is a side-view of a wheel which has a sound-emitting dimpled surface in accordance with some embodiments of the present disclosure.
Figure 7B:
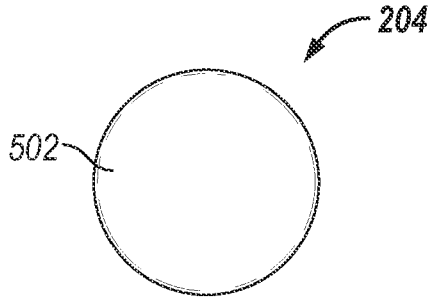
FIG. 7B is a top-down view of the wheel of FIG. 7A.

FIGS. 7A and 7B are a side-view and a top-down view, respectively, of a wheel 204 which has a sound-emitting dimpled surface in accordance with some embodiments of the present disclosure. The facets 216 in this example comprise dimples, however other concave surfaces with other geometries are possible.

Figure 8A:
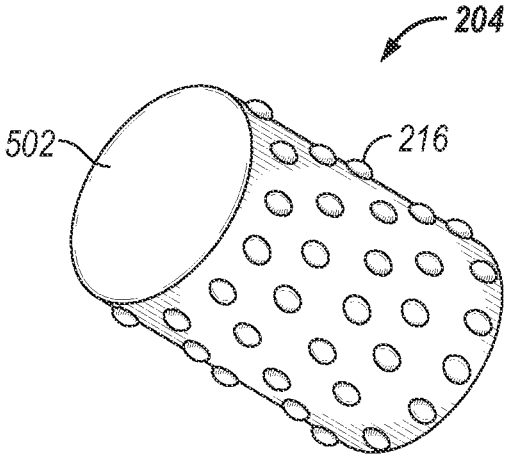
FIG. 8A is a side-view of a wheel which has sound-emitting convex protrusions in accordance with some embodiments of the present disclosure.
Figure 8B:
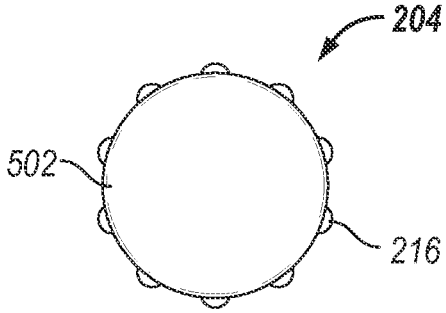
FIG. 8B is a top-down view of the wheel of FIG. 8A.

FIGS. 8A and 8B are a side-view and a top-down view, respectively, of a wheel 204 which has sound-emitting facets 216 comprising convex protrusions in accordance with some embodiments of the present disclosure. As with previous figures, alternative configurations to those shown are possible.

Figure 9A:
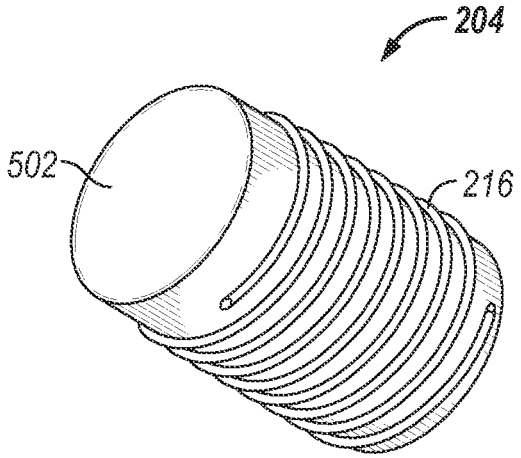
FIG. 9A is a side-view of a wheel which has sound-emitting ridges radially disposed about the wheel in accordance with some embodiments of the present disclosure.
Figure 9B:
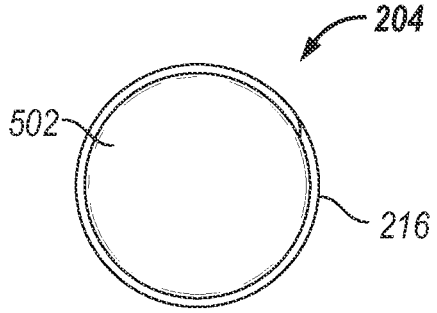
FIG. 9B is a top-down view of the wheel of FIG. 9A.

FIGS. 9A and 9B are a side-view and a top-down view, respectively, of a wheel 204 which has sound-emitting facets 216 comprising protrusions extending radially outwards from the body of wheel 204. In alternative examples, rather than radial protrusions, a single facet 216 may helically wrap around the body of wheel 204.

Figure 10:
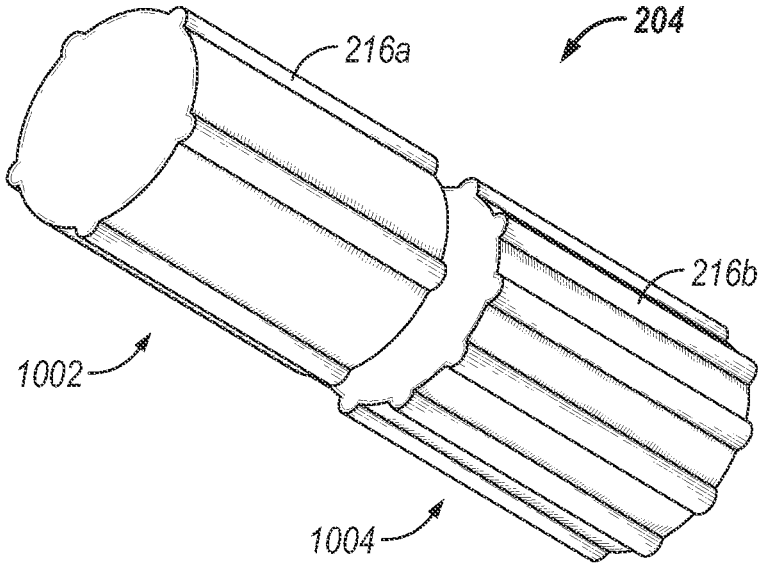
FIG. 10 is a side-view of a pair of side-by-side wheels with different numbers of facets and configured to emit two tones in accordance with some embodiments of the present disclosure.

FIG. 10 is a side-view of a wheel 204 which has a first section 1002 and a second section 1004. As illustrated, the facets 216*a* of the first section 1002 may be of a different number than the facets 216*b* of the second section 1004. This may result in a "two-tone emitter" which produces acoustic signals having two different frequencies.

Figure 11:
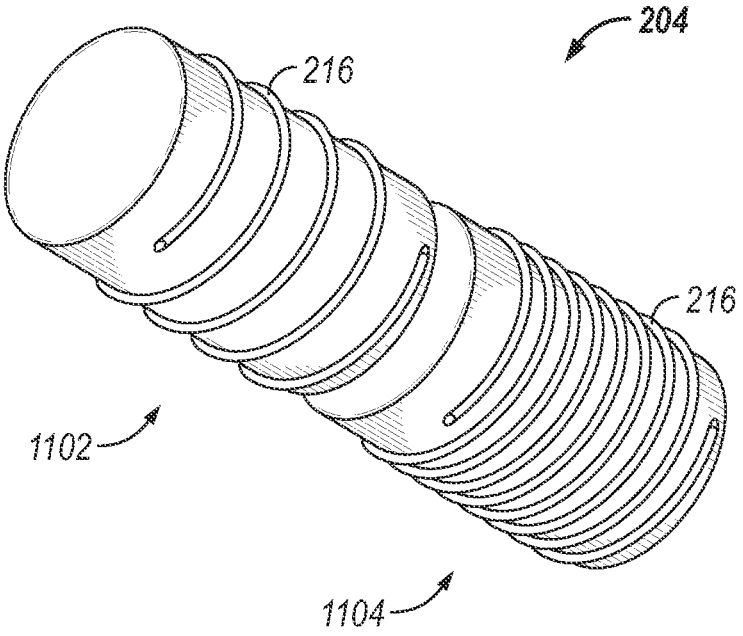
FIG. 11 is a side-view of a pair of side-by-side wheels with different numbers of facets radially disposed about the respective wheels and configured to emit two tones in accordance with some embodiments of the present disclosure.

FIG. 11 is a side-view of a wheel 204 which has a first section 1102 and a second section 1104. This figure is substantially similar to FIG. 10, except that the facets 216*a*, 216*b* are disposed radially about the body of the wheel 204 instead of extending along an axial length thereof.

Figure 12:
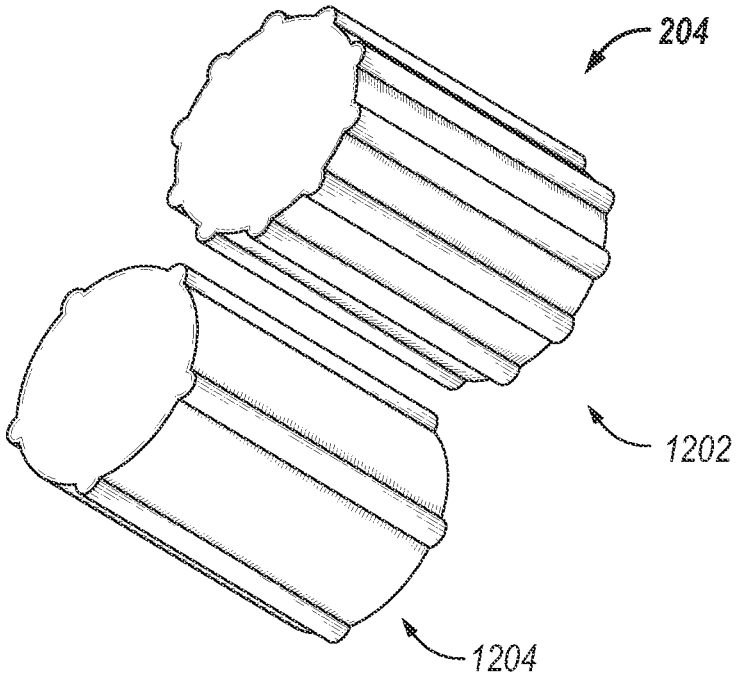
FIG. 12 is a side view of a wheel comprising a leading wheel and a trailing wheel in accordance with some embodiments of the present disclosure.

FIG. 12 is a side view of a wheel 204 comprising a leading wheel 1202 and a trailing wheel 1204. In these examples, the relative amplitude of the differing frequencies from the leading and trailing wheels 1202, 1204, respectively, may be used to determine the time at which wheel 204 swings past a sensing cable 108 (e.g., referring to FIG. 1). In these types of configurations, as wheel 204 approaches a sensing cable 108, the acoustic signal 424 (e.g., referring to FIG. 4B) of leading wheel 1202 dominates, but the trailing wheel 1204 dominates when wheel 204 passes the sensing cable 108. The inflection points at which this changes are the moments when the source of the acoustic signal 424 is closest to the sensing cable 108, and thus this may be used to infer when a sounding arm is closest to the sensing cable 108. This same principle may apply not only to multi-faceted surfaces of wheels, but also to other types of two-tone emitters, such as directional acoustic emitters configured to emit at two different frequencies. Similar inflection points may also be inferred when multiple centralizers/sounding arms are used, or when both centralizer(s) and directional acoustic emitter (s) are used, etc., or the like. For example, without limiting to any particular embodiment, the computer analyzer 122 (e.g., referring to FIG. 1) may analyze acoustic signals from multiple acoustic emitters, such as acoustic signals 418 and 424 (e.g., referring to FIG. 4B), to determine the relative angular orientation, azimuthal orientation, and/or depth of the tool string, etc., relative to sensing cable 108.

The acoustic emitter(s) of the present disclosure may, in some examples, emit sound waves having an acoustic intensity, individually or in combination, from about 0.01 decibel (dB) to about 200 dB. Alternatively, from about 0.01 dB to about 1 dB, about 1 dB to about 10 dB, about 10 dB to about 80 dB, about 80 dB to about 150 dB, about 150 dB to about 200 dB, or any ranges therebetween. In examples, the sound waves may be of sufficient amplitude and/or frequency to be detectable through one, two, three, or more layers of casing (e.g., casing 114 of FIG. 1), and a cement-filled annulus (e.g., annular area 124 of FIG. 1). In some examples, the frequency of an acoustic signal (e.g., acoustic signals 410, 424 of FIGS. 4A, 4B) may be from about 0.1 hertz (Hz) to about 1,500 Hz. Alternatively, from about 0.1 Hz to about 10 Hz, about 10 Hz to about 100 Hz, about 100 Hz to about 1,000 Hz, about 1,000 Hz to about 1,500 Hz, or any ranges therebetween.

Figure 13:
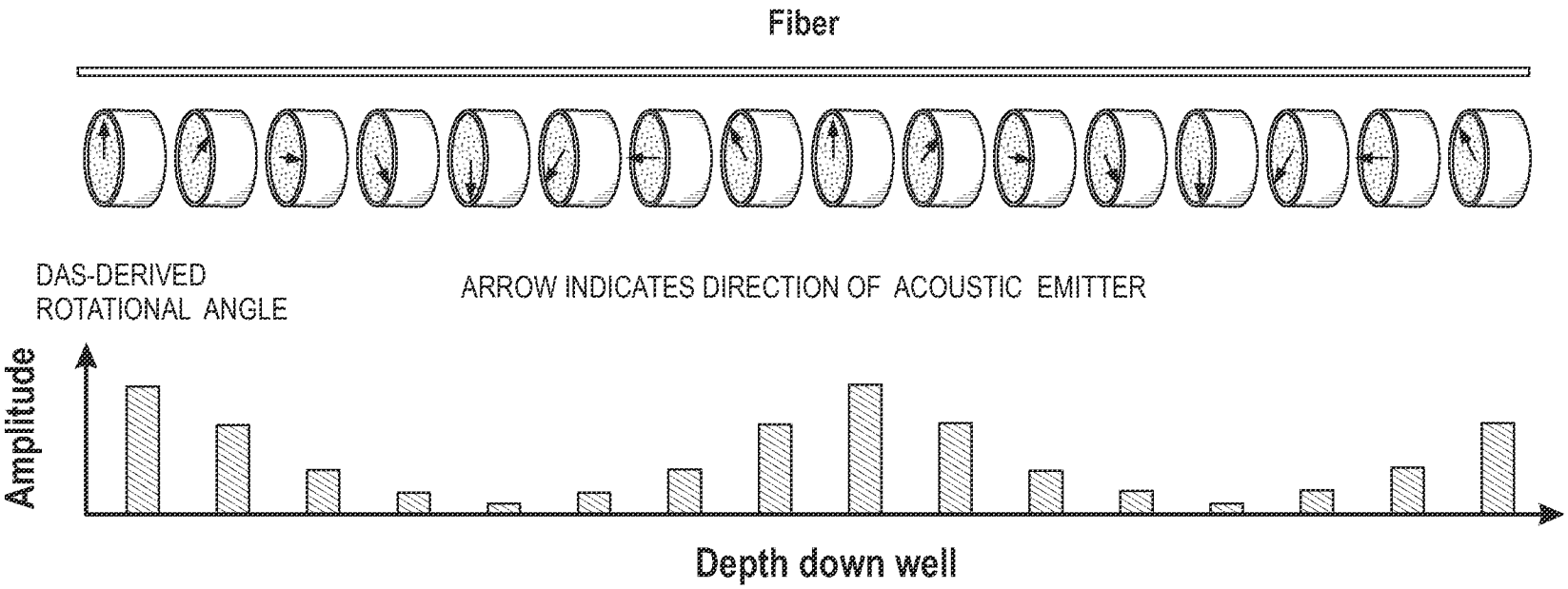
FIG. 13 is a plot showing the relationship between wellbore depth and a distributed acoustic sensing (DAS)-derived rotation angle for a well that has a helically-wrapped sensing cable disposed about the casing in accordance with some embodiments of the present disclosure.

FIG. 13 is a plot showing the relationship between wellbore depth and a distributed acoustic sensing (DAS)-derived rotation angle for a well that has a helically-wrapped sensing cable disposed about the casing in accordance with one or more embodiments of the present disclosure. As illustrated, the angular orientation of the tool string may be correlated with the amplitudes of an acoustic emitter or else derived using alternative methods. In this figure, higher amplitudes indicate proximity of the DAS fiber to the tool string, whereas lower amplitudes indicate the opposite. The left-to-right progression shows how the tool string rotates as it traverses the well, resulting in the sinusoidal-appearing trends that allow for a determination of the angular orientation of the tool string, and thus firing angle, with respect to the DAS fiber.

Figure 14:
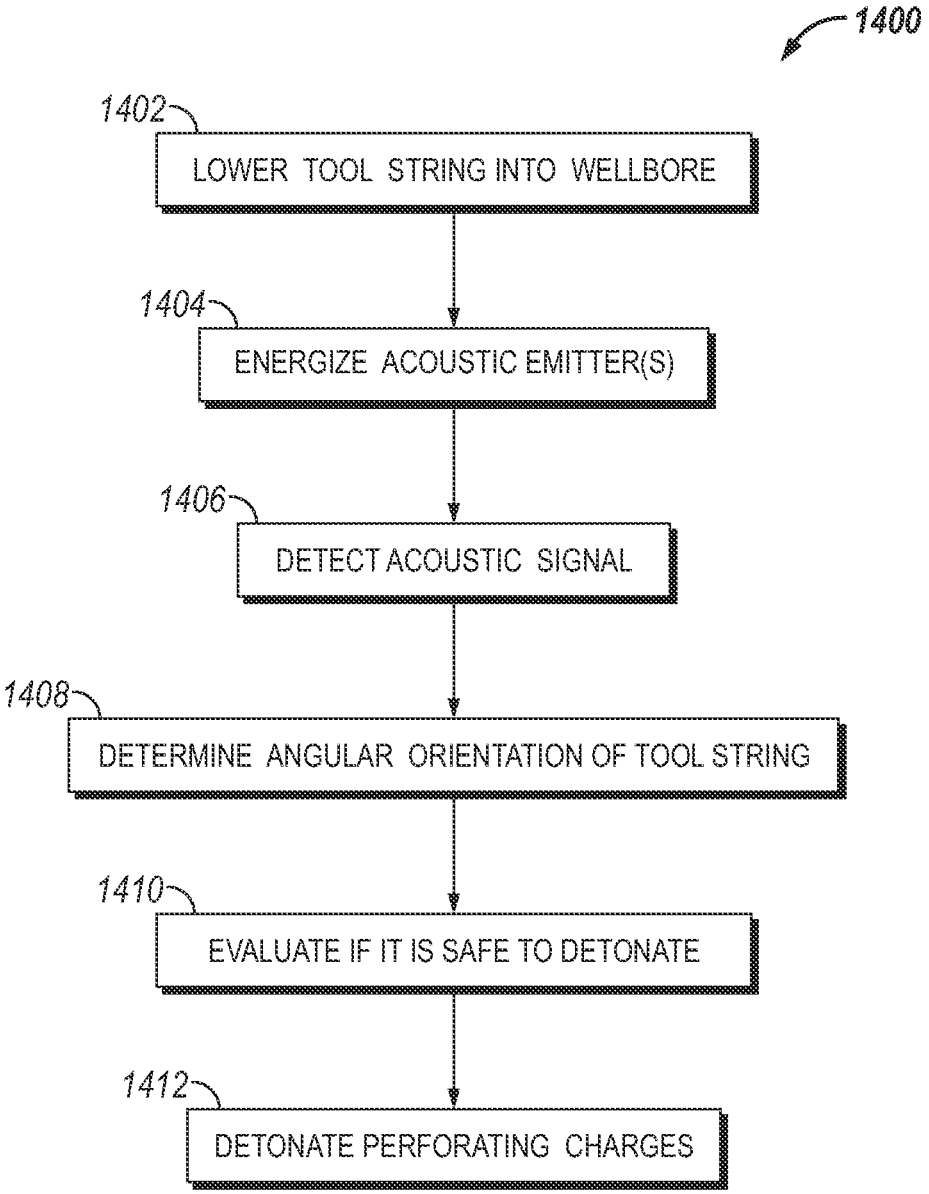
FIG. 14 is a workflow in accordance with some embodiments of the present disclosure.

FIG. 14 is a workflow 1400 for an example method of perforating a casing in accordance with one or more examples of the present disclosure. In block 1402, a tool string 102 (e.g., referring to FIG. 1) is lowered into a wellbore 106. In block 1404, one or more acoustic emitters of the tool string 102 is/are energized, thereby forming an acoustic signal detectable by sensing cable 108. The sensing cable 108 detects the acoustic signal in block 1406 and optionally, relays it to the surface 132 where the data may be deconvoluted and/or analyzed, e.g., by a computer analyzer or information handling system. In block 1408, the angular orientation of the tool string is determined. This may involve, for example, correlational methods, Doppler shift analysis, phase-locked loop methods, etc., as discussed in this disclosure. In block 1410, an evaluation is performed to determine if it is safe to detonate the perforating charges. If so, the method may proceed to detonation in block 1412. Otherwise, movement of the tool string may be resumed until, for example, it becomes safe to detonate, such as when the tool string advances to a location where the firing direction 308 (e.g., referring to FIG. 3A) is clear of the sensing cable 108.

Accordingly, the present disclosure may provide a tool string and related methods for sensing the angular orientation of the tool string and perforating casing without shooting through sensing cables. The methods and systems may include any of the various features disclosed herein, including one or more of the following statements.

Statement 1: A method, comprising: lowering a tool string down into a wellbore extending into a subterranean formation, wherein the tool string comprises: perforating charges; and one or more acoustic emitters; energizing the one or more acoustic emitters to form at least an acoustic signal while the tool string is being drawn up-hole; detecting the acoustic signal with a sensing cable disposed within the wellbore; determining an angular orientation of the tool string relative to the sensing cable based at least in part on the acoustic signal; and detonating at least one of the perforating charges when its firing direction is not directed at the one or more sensing cables.

Statement 2: The method of statement 1, wherein drawing the tool string up-hole comprises rotating the tool string in the wellbore using tilted wheels.

Statement 3: The method of statement 2, further comprising stopping the tool string in the wellbore after determining that the firing direction is clear of the sensing cable at a given depth or location in the wellbore.

Statement 4: The method of any of statements 1-3, wherein the one or more acoustic emitters comprise a directional acoustic emitter having a body and an energizable member disposed within the body.

Statement 5: The method of any of statements 1-4, wherein the one or more acoustic emitters comprise at least one acoustically energizable, multi-faceted wheels configured to emit the acoustic signal during movement of the tool string along casing in the wellbore.

Statement 6: The method of any of statements 1-5, wherein the one or more acoustic emitters comprise a two-tone emitter.

Statement 7: The method of any of statements 1-6, wherein the acoustic signal comprises a constant frequency.

Statement 8: The method of any of statements 1-7, wherein determining of the orientation is based at least in part on detecting a Doppler shift of the acoustic signal, and/or wherein a phase-locked loop is used to track the detected acoustic signal.

Statement 9: The method of any of statements 1-8, wherein the tool string further comprises one or more centralizers attached to an outer body of the tool string.

Statement 10: The method of statement 9, wherein the one or more centralizers each comprise an extendible arm attached to the gun body, and a wheel coupled to the extendible arm, wherein the one or more centralizers are biased outwards to springingly engage a casing string disposed in the wellbore.

Statement 11: The method of any of statements 1-10, further comprising selectively detonating a first set of perforating charges at the firing angle, and then selectively detonating a second set of perforating charges at another firing angle, wherein the selective detonation of the first and second set of charges are based at least in part on the determining of the angular orientation of the tool string relative to the sensing cable.

Statement 12: The method of any of statements 1-11, further comprising sending a timing pulse down a wireline to synchronously activate at least one of the one or more acoustic emitters.

Statement 13: The method of any of statements 1-12, wherein energizing the one or more acoustic emitters and detonating the at least one perforating charge are each performed using the tool string.

Statement 14: The method of any of statements 1-13, further comprising activating a tractor coupled to the tool string.

Statement 15: A tool string, comprising: a gun body; perforating charges disposed within the gun body; and one or more acoustic emitters disposed within or on the tool string, wherein the one or more acoustic emitters are configured to produce at least an acoustic signal detectable by a sensing cable behind a casing.

Statement 16: The tool string of statement 15, wherein the one or more acoustic emitters comprises a directional acoustic emitter.

Statement 17: The tool string of statement 15 or 16, wherein the one or more acoustic emitters comprise one or more sounding arms.

Statement 18: The tool string of any of statements 15-17, wherein the one or more sounding arms comprise at least one multi-faceted, acoustically-energizable wheel.

Statement 19: A well system, comprising: a tool string comprising a gun body, one or more perforating charges, and an acoustic emitter, wherein the acoustic emitter is configured to produce an acoustic signal; and one or more sensing cables configured to detect the acoustic signal.

Statement 20: The well system of statement 19, further comprising: a gun firing panel; a hoist; a computer analyzer; and a distributed acoustic sensing interrogator.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method, comprising:

lowering a tool string down into a wellbore extending into a subterranean formation, wherein the tool string comprises:

perforating charges; and one or more acoustic emitters;

energizing the one or more acoustic emitters to form at least an acoustic signal while the tool string is being drawn up-hole;

detecting the acoustic signal with a sensing cable disposed within the wellbore;

determining an angular orientation of the tool string relative to the sensing cable based at least in part on the acoustic signal; and detonating at least one of the perforating charges when its firing direction is not directed at the one or more sensing cables.

2. The method of claim 1, wherein drawing the tool string up-hole comprises rotating the tool string in the wellbore using tilted wheels.

3. The method of claim 2, further comprising stopping the tool string in the wellbore after determining that the firing direction is clear of the sensing cable at a given coordinate in the wellbore.

4. The method of claim 1, wherein the one or more acoustic emitters comprise a directional acoustic emitter having a body and an energizable member disposed within the body.

5. The method of claim 1, wherein the one or more acoustic emitters comprise at least one acoustically energizable, multi-faceted wheels configured to emit the acoustic signal during movement of the tool string along casing in the wellbore.

6. The method of claim 1, wherein the one or more acoustic emitters comprise a two-tone emitter.

7. The method of claim 1, wherein the acoustic signal comprises a constant frequency.

8. The method of claim 1, wherein determining the angular orientation is based at least in part on detecting a Doppler shift of the acoustic signal, and/or wherein a phase-locked loop is used to track the detected acoustic signal.

9. The method of claim 1, wherein the tool string further comprises one or more centralizers attached to an outer body of the tool string.

10. The method of claim 9, wherein the one or more centralizers each comprise an extendible arm attached to a gun body, and a wheel coupled to the extendible arm, wherein the one or more centralizers are biased outwards to springingly engage a casing string disposed in the wellbore.

11. The method of claim 1, further comprising selectively detonating a first set of perforating charges at the firing direction, and then selectively detonating a second set of perforating charges at another firing direction, wherein the selective detonation of the first set of perforating charges and the second set of perforating charges are based at least in part on the determining of the angular orientation of the tool string relative to the sensing cable.

12. The method of claim 1, further comprising sending a timing pulse down a wireline to synchronously activate at least one of the one or more acoustic emitters.

13. The method of claim 1, wherein energizing the one or more acoustic emitters and detonating the at least one perforating charge are each performed using the tool string.

14. The method of claim 1, further comprising activating a tractor coupled to the tool string.

15. A tool string, comprising:

a gun body;

perforating charges disposed within the gun body; and one or more acoustic emitters, disposed within or on the tool string, configured to produce at least an acoustic signal detectable by a sensing cable behind a casing, wherein the one or more acoustic emitters comprise one or more sounding arms, and wherein the one or more sounding arms comprise at least one multi-faceted, acoustically-energizable wheel.

16. The tool string of claim 15, wherein the one or more acoustic emitters comprises a directional acoustic emitter.

17. A system, comprising:

a tool string comprising:

a gun body;

a perforating charge; and an acoustic emitter configured to produce an acoustic signal, wherein the acoustic emitter comprises a sounding arm, wherein the sounding arm comprises a multi-faceted, acoustically-energizable wheel; and one or more sensing cables configured to detect the acoustic signal.

18. The system of claim 17, further comprising:

a gun firing panel communicatively coupled to the tool string;

a hoist for raising and lowering the tool string; and a distributed acoustic sensing interrogator and computer analyzer optically connected to the one or more sensing cables.

19. The tool string of claim 17, wherein the tool string further comprises a centralizer attached to an outer body of the tool string.

20. The tool string of claim 17, wherein the acoustic emitter comprises a directional acoustic emitter.

* * * * *